US011147310B2

(12) United States Patent
Evans

(10) Patent No.: US 11,147,310 B2
(45) Date of Patent: Oct. 19, 2021

(54) COLLAPSIBLE CONTAINER

(71) Applicant: Altria Client Services LLC, Richmond, VA (US)

(72) Inventor: James D. Evans, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 211 days.

(21) Appl. No.: 15/331,345

(22) Filed: Oct. 21, 2016

(65) Prior Publication Data

US 2017/0258131 A1 Sep. 14, 2017

Related U.S. Application Data

(62) Division of application No. 14/020,085, filed on Sep. 6, 2013, now Pat. No. 9,497,992.

(Continued)

(51) Int. Cl.
*A24F 23/02* (2006.01)
*A24F 23/00* (2006.01)

(Continued)

(52) U.S. Cl.
CPC ..... *A24F 23/02* (2013.01); *A24F 23/00* (2013.01); *B65D 21/08* (2013.01); *B65D 55/06* (2013.01)

(58) Field of Classification Search
CPC ..... B65D 55/06; B65D 21/08; B65B 7/2835; B65B 29/00; B65B 61/24

(Continued)

(56) References Cited

U.S. PATENT DOCUMENTS 2,124,959 A 7/1938 Vogel
3,043,461 A * 7/1962 Glassco ..... B65D 1/0276 215/375

(Continued)

FOREIGN PATENT DOCUMENTS

WO WO 2008/066288 6/2008
WO WO 2010/060845 6/2010

OTHER PUBLICATIONS

International Search Report and Written Opinion in International Application No. PCT/US2013/058455, dated Nov. 4, 2013, 12 pages.

*Primary Examiner* — Andrew M Tecco
*Assistant Examiner* — Nicholas E Igbokwe
(74) *Attorney, Agent, or Firm* — Harness, Dickey & Pierce, P.L.C.

(57) ABSTRACT

Articles of manufacture, products, and packaging methods are provided that include collapsible container. Collapsible containers provided herein can define an open interior space with a peripheral side wall having a top edge and a bottom edge and a bottom wall attached to the bottom edge of the side wall. The bottom wall can include a displaceable portion in an expanded configuration that extends below the bottom edge of the side wall and adapted to being displaced to a collapsed configuration that extends above the bottom edge of the side wall. Product constituents (e.g., pouches of smokeless tobacco) can be placed in a collapsible container provided herein while the collapsible container is in its expanded configuration. After installing a lid onto a collapsible container to enclose the product within the collapsible container, the container can be collapsed to its collapsed configuration.

2 Claims, 4 Drawing Sheets

Related U.S. Application Data

(60) Provisional application No. 61/697,919, filed on Sep. 7, 2012.

(51) Int. Cl.
*B65D 21/08* (2006.01)
*B65D 55/06* (2006.01)

(58) Field of Classification Search
USPC ..... 53/415, 471; 206/242, 265; 131/352
See application file for complete search history.

(56) References Cited

U.S. PATENT DOCUMENTS 3,426,939 A * 2/1969 Young ..... B65D 79/005 220/609
4,098,421 A 7/1978 Foster
4,222,494 A 9/1980 Lee et al.
4,334,627 A * 6/1982 Krishnakumar ..... B29C 45/26 215/373
4,796,411 A * 1/1989 Kimura ..... B65D 1/34 426/111
4,969,563 A * 11/1990 Strassheimer ..... B29C 49/0078 215/373
5,428,943 A * 7/1995 Balcombe ..... B65B 31/028 426/111
6,077,554 A 6/2000 Wiemann et al.
6,431,389 B1 * 8/2002 Jerstroem ..... A47J 36/02 220/574
D515,928 S 2/2006 Pace
7,798,319 B1 * 9/2010 Bried ..... B65D 51/16 206/242
7,950,399 B2 5/2011 Winterson et al.
8,381,940 B2 2/2013 Melrose et al.
8,458,996 B2 6/2013 Bried et al.
8,701,881 B2 4/2014 Gibson et al.
8,881,896 B2 11/2014 Gibson et al.
2004/0256484 A1 * 12/2004 Joseph ..... B01D 35/02 239/302
2005/0175741 A1 8/2005 Reinders
2008/0173317 A1 7/2008 Robinson et al.
2009/0014343 A1 1/2009 Clark et al.
2009/0230003 A1 9/2009 Thiellier
2010/0012534 A1 * 1/2010 Hoffman ..... B21D 51/44 206/265
2010/0018883 A1 1/2010 Patel
2012/0181276 A1 * 7/2012 Ichikawa ..... A61J 1/03 220/200
2012/0247986 A1 * 10/2012 Wattenbarger ..... A45C 13/002 206/265
2013/0008809 A1 1/2013 Cortez
2014/0069829 A1 3/2014 Evans
2014/0262870 A1 9/2014 Sims et al.

* cited by examiner

COLLAPSIBLE CONTAINER

CROSS-REFERENCE TO RELATED APPLICATIONS

This application is a Divisional of U.S. application Ser. No. 14/202,085, filed Sep. 6, 2013, which claims priority to U.S. Provisional Application Ser. No. 61/697,919, filed on Sep. 7, 2012, which is hereby incorporated by reference.

TECHNICAL FIELD

This disclosure generally relates to collapsible containers, packaged products provided in a collapsible container, and methods of packaging products. In some cases, the packaged product includes tobacco (e.g., pouched smokeless tobacco).

WORKING ENVIRONMENT

Smokeless tobacco products are often packaged in a cylindrical can. Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

This document describes articles of manufacture, products, and packaging methods pertaining to a collapsible container. Product constituents (e.g., pouches of smokeless tobacco) can be placed in a collapsible container provided herein while the collapsible container is in its expanded configuration. Collapsible containers provided herein can be collapsed from a first stable configuration to a second stable configuration having a smaller volume. In some cases, a collapsible container provided herein is reconfigured during or after installing a lid onto the collapsible container. The aforementioned materials and methods can improve consistency of proper seals between lids and collapsible containers provided herein when one or more products are packaged in a collapsible container. Collapsible containers provided herein can contribute to improved sealing by providing more space for product constituents during filling, thereby reducing the occurrences of interference by product constituents falling between the sealing interfaces of the lid and the collapsible container. Improved sealing consistency contributes to less manufacturing waste and a more consistently fresh product. Once a lid is applied, a collapsible container provided herein can be collapsed to provide a container having a high product density.

In one aspect, this document features a collapsible container defining an open interior space. The collapsible container comprises a peripheral side wall having a top edge and a bottom edge; and a bottom wall attached to the bottom edge of the side wall. The bottom wall includes a displaceable portion in an expanded configuration that extends below the bottom edge of the side wall. The displaceable portion is adapted to being displaced to a collapsed configuration that extends above the bottom edge of the side wall. The displaceable portion can comprise a truncated cone shape. A bottom exterior surface of the truncated come shape can be concave. The collapsible container can be made of a polymeric material. The collapsible container can include a lid that can releasably engage with a top peripheral region of the side wall, wherein the open interior space is fully enclosed when the lid is engaged with the top peripheral region of the side wall. The lid can be made of metal. The top peripheral region can be configured to provide a snap-fit engagement with the lid. The collapsible container can include a tobacco product disposed in the open interior space. In some cases, the collapsible can reduce in volume by 10-30% when the displaceable portion is collapsed. In some cases, the displaceable portion can extend approximately 0.05-0.20 inches below the bottom edge of the side wall.

In another aspect, this document features a packaged smokeless tobacco product. The packaged smokeless tobacco product comprises: a container defining an interior space, the container including a peripheral side wall having a top edge and a bottom edge, and a bottom wall attached to the bottom edge of the peripheral side wall with a displaceable portion adapted to be forcibly reconfigured between an expanded position defining an increased container volume and a collapsed position defining a decreased container volume; a tobacco product disposed in the interior space; a lid that releasably engages with a top peripheral region of the peripheral side wall, to fully enclose the interior space when the lid is engaged with the top peripheral region of the peripheral side wall; and a label that surrounds an outer surface of the peripheral side wall and contacts a portion of the lid. The displaceable portion can comprise a truncated cone shape. An exterior surface of the truncated cone shape can be concave. The label can hermetically seal the container and the lid. The tobacco product can comprise a plurality of pouches containing tobacco.

In another aspect, this document features a method of packaging a consumer product. The method of packaging a consumer product comprises: depositing product into a collapsible container, the collapsible container including; (i) a peripheral side wall having a top edge and a bottom edge and (ii) a bottom wall attached to the bottom edge of the side wall, the bottom wall including a displaceable portion in an expanded configuration that extends below the bottom edge of the side wall and adapted to being displaced to a collapsed configuration that extends above the bottom edge of the side wall; and applying a force to an exterior surface of the displaceable portion to cause the displaceable portion to mechanically buckle and thereafter be disposed in the collapsed configuration. The method of packaging a consumer product can further comprise: prior to applying the force, engaging a lid with a top peripheral region of the peripheral side wall, wherein the lid retains the product within the collapsible container. The method of packaging a consumer product can further comprise: applying a label, wherein the label surrounds an outer surface of the peripheral side wall and contacts a portion of the lid. The label can hermetically seal the container and the lid.

While the products and methods provided herein are generally described in reference to certain smokeless tobacco products, it should be understood that these products and methods can also be applied to other packaged products. For example, a collapsible container provided herein can be used to package non-tobacco or "herbal" compositions, which may be used an alternative to smokeless tobacco compositions. Non-tobacco products may include a number of different primary ingredients, including but not limited to, tea leaves, red clover, coconut flakes, mint leaves, *ginseng*, apple, corn silk, grape leaf, and basil leaf. In some cases, a non-tobacco product packaged in a collapsible container provided herein includes a non-tobacco material within a pouch. In some cases, a non-tobacco product can include one or more tobacco extracts. In some cases, tobacco extracts added to a packaged product can include nicotine. In some cases, a non-tobacco smokeless product packaged in a collapsible container provided herein can include an extract of tobacco including two or more tobacco organoleptic components.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

Like reference symbols in the various drawings indicate like elements.

DETAILED DESCRIPTION

Articles of manufacture, products, and methods for packaging products using a collapsible container are provided herein. A collapsible container provided herein can be capable of being converted between two configurations: (i) an expanded configuration and (ii) a collapsed configuration. Both configurations can be physically and mechanically stable. A collapsible container provided herein can be filled with one or more products (e.g., smokeless tobacco pouches) while the collapsible container is in an expanded configuration. During and/or after product filling and installation of a packaging lid, a collapsible container provided herein can be reconfigured from an expanded configuration to a collapsed configuration. Changing the configuration can increase the packaging density of product within the collapsible container and/or improve the sealing consistency between a lid and a collapsible container provided herein.

Figure 1:
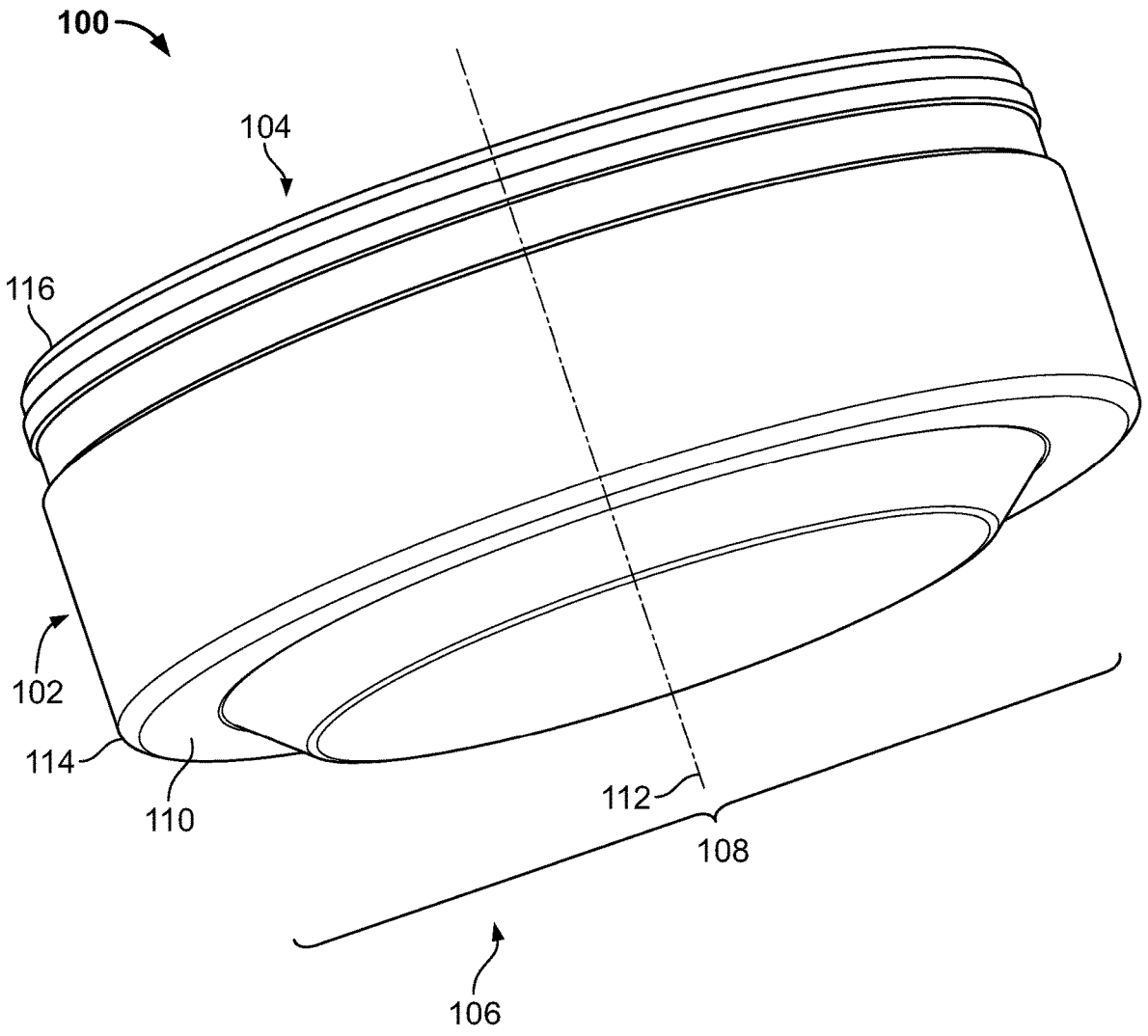
FIG. 1 is a perspective view of a collapsible container in an expanded configuration.

Referring to FIG. 1, an example of a collapsible container 100 is shown. The example collapsible container 100 generally includes a side wall 102, an open top 104, and a bottom wall 106. The side wall 102 provides a periphery around an open interior space and defines a longitudinal axis 112 of the collapsible container 100. The side wall includes a bottom edge 114 and a top edge 116. The open interior space of the collapsible container 100 can be used to contain one or more products such as a smokeless tobacco product. Although the side wall 102 is depicted as cylindrical, the side wall 102 can be shaped in a variety of other configurations, including but not limited to elliptic, square, and rectangular. The side wall 102 can have its outer rim at its top peripheral region adapted for mating with a lid, for example in a snap-fit or a slide-lock manner, as will be described in reference to FIG. 3 below. The outer surface of side wall 102 can provide a surface for placement of a label corresponding to the product contents of the collapsible container 100. The collapsible container 100 can have the open top 104 at the top longitudinal end of the side wall 102. The open top 104 can provide access to the open interior space of the collapsible container 100. Such access can allow for, for example, filling the collapsible container 100 with product during manufacturing and dispensing product from the collapsible container 100.

Figure 2A:
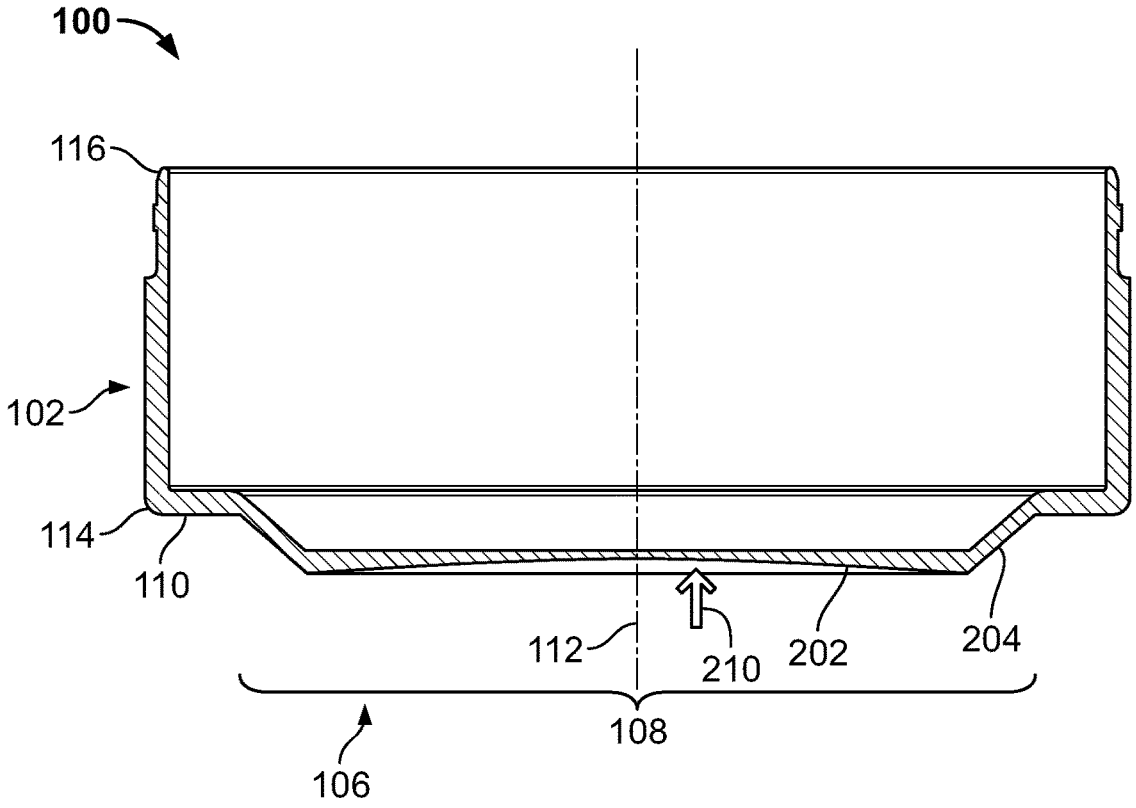
FIG. 2A is a cross-sectional view of a collapsible container in an expanded configuration.

The collapsible container 100 can have a bottom wall 106 attached at the bottom edge 114 of the side wall 102. The periphery of bottom wall 106 can be, for example, attached to or contiguous with the bottom edge 114 of the side wall 102 so as to enclose the bottom end of the collapsible container 100. The bottom wall 106 can include a displaceable portion 108 and a fixed bottom portion 110. The displaceable portion 108, in a first or expanded configuration as shown in FIGS. 1 and 2A, can extend axially away from the open top end 104 of the collapsible container 100 (or downward) so as to increase the volume of the interior space. In an example embodiment, the displaceable portion 108 in the expanded configuration can increase the volume of the interior space by 4-25% (e.g., between 4-20%, between 6-14%, or between 8-12%) in comparison to a container with a flat bottom. As will be described further below in reference to FIG. 2B, the displaceable portion 108 also has a second or collapsed configuration wherein the displaceable portion 108 extends upward towards the open top end 104 to reduce the volume of the interior space of the collapsible container 100 provided herein.

The displaceable portion 108, in its expanded configuration, can be made to provide a stable base for the collapsible container 100 such that, for example, the collapsible container 100 is stable when sitting on a table. The stability of the collapsible container 100 can be used to enhance the conveyance of the collapsible container 100 during the product packaging process. The displaceable portion 108 can include a generally flat bottom surface. The displaceable portion 108 can have three or more planar points that are configured to make contact with a supporting surface. For example, the displaceable portion 108 of example collapsible container 100 has a circular base in a common plane which can contact a supporting surface when the displaceable portion 108 is in an expanded configuration.

A collapsible container 100 provided herein can include a bottom wall 106 having a fixed bottom portion 110. The fixed bottom portion 110 can remain stationary in an orientation with respect to the side wall 102 despite a reconfiguring of displaceable portion 108 from an expanded configuration to a collapsed configuration. After conversion of the collapsible container 100 to a collapsed configuration, the fixed bottom portion 110 can become the base of the collapsible container 100 instead of the displaceable portion 108, which can have acted as the base in the expanded configuration. In these embodiments, the fixed bottom portion 110 may be annular, may be essentially co-planar with a plane defined by the bottom edge 114, may be disposed about the displaceable portion 108, and may be essentially free of displacement upon displacement of the displaceable portion 108.

In some cases, a collapsible container provided herein can have a bottom wall 106 that consists essentially of a displaceable portion 108. In such cases, when the displaceable portion 108 is in the collapsed configuration the bottom edge 114 of the side wall 102 can act as the base of the collapsible container 100.

The collapsible container 100 provided herein can be made from any suitable material and by suitable manufacturing technique. For example, a collapsible container 100 provided herein can be constructed of a type of flexible polymeric material (e.g., polypropylene, polyethylene, polystyrene, polyurethane, or the like) using an injection molding process. Alternatively, the container can include a material such as a fiberboard or metallic material that is suitable for the product to be contained. In some cases, a collapsible container 100 provided herein can be formed by injection molding and/or thermoforming.

FIG. 2A depicts a cross-sectional view of the example collapsible container 100. An interior space is generally defined by a side wall 102 and a bottom wall 106 as shown. As described above, the bottom wall 106 can include a fixed bottom portion 110 and a displaceable portion 108. The displaceable portion 108 can include a collapsible wall 202 and a flexible web 204.

The displaceable portion 108 can be adapted to be reconfigured from an expanded configuration to a collapsed configuration using a snap-through buckling capability. Snap-through buckling is a behavior of a structure where an application of a force to the structure causes a relatively sudden and large displacement to the structure as it transitions from one equilibrium position to another. To illustrate, a snap-through jump in displacement can occur by application of a force to the convex side of a curved beam having both ends fixed. The force will cause compressive stresses to increase as the beam deflects towards a mid-point where the beam nominally has no curvature. As the beam deflects slightly past the mid-point, the built-up stresses will suddenly release causing the beam to transition to a second equilibrium position where the beam is curved in a direction opposite from the original curve. Hence, a force can cause a snap-through jump in displacement.

The displaceable portion 108 is depicted in FIG. 2A as constructed analogously to the curved beam in the illustration above. As shown, a flexible web 204 can be angled with respect to the longitudinal axis 112. Therefore, the flexible web 204 in combination with a collapsible wall 202, create a member that is generally curved. Additionally, the outer periphery of the flexible web 204 is effectively pinned (like the curved beam of the illustration discussed above) since it is joined with an inner periphery of fixed bottom portion 110.

The snap-through deflection of example collapsible container 100 will now be explained. As a force 210 is applied to the collapsible wall 202, various portions of the displaceable portion 108 begin to deflect. The collapsible wall 202 becomes concaved from the perspective of outside the container. The angle of flexible web 204 becomes more perpendicular to the longitudinal axis 112. As the deflections continue, eventually a mid-point position is reached and soon thereafter the displaceable portion 108 snaps-through to the collapsed configuration (FIG. 2B).

The displaceable portion 108 can include certain features to enhance its snap-through buckling capability. For example, as shown, the collapsible wall 202 can be thinner at its center (near the longitudinal axis 112) as compared to its outer periphery. Such a variable wall thickness design can enhance the flexibility of the collapsible wall 202 and enable it to deflect as needed to achieve snap-through buckling. Further, material relief areas at the hinge points associated with flexible web 204 can be employed to enhance the flexibility of the displaceable portion 108. Still further, the material selected to construct bottom wall 106 may need, for example, an appropriate modulus of elasticity, strength, and ductility to facilitate the snap-through buckling capability of the displaceable portion 108.

Figure 2B:
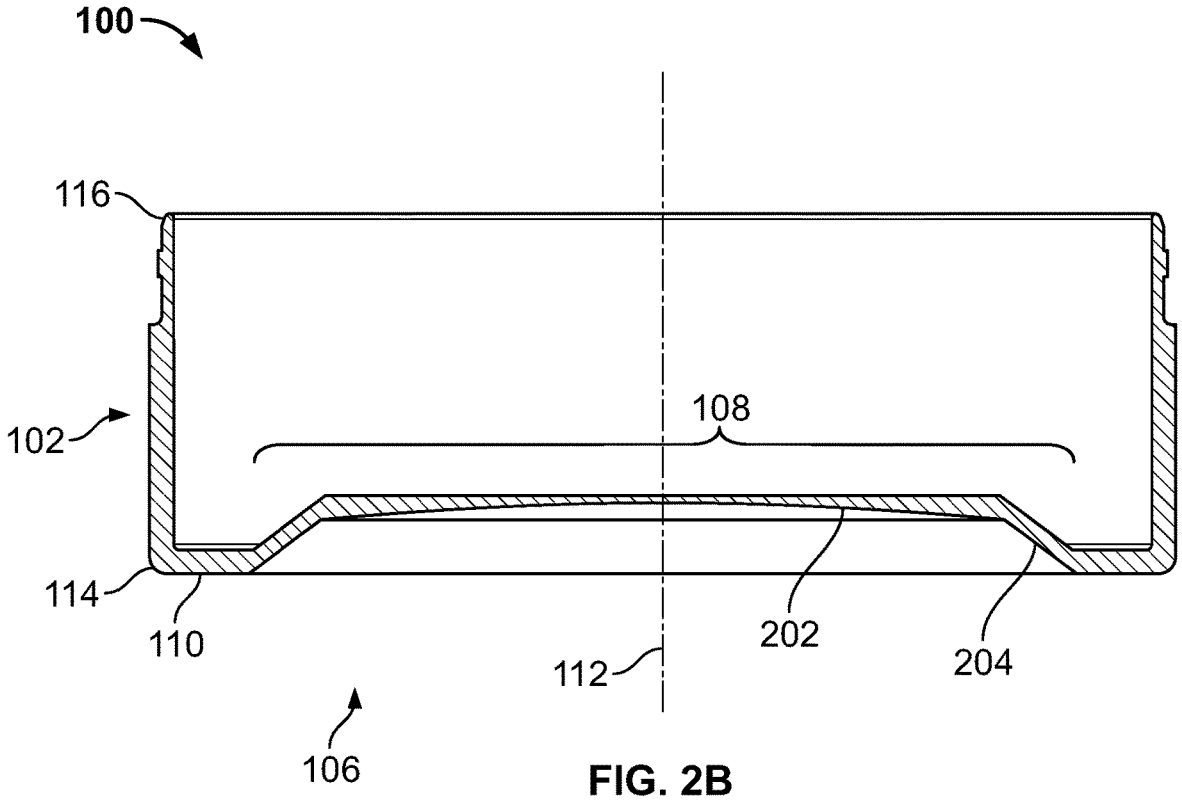
FIG. 2B is a cross-sectional view of a collapsible container in a collapsed configuration.

FIG. 2B depicts the example collapsible container 100 with the displaceable portion 108 in the collapsed configuration. The collapsible wall 202 is now disposed above the fixed bottom portion 110—whereas in the expanded configuration collapsible wall 202 was disposed below the fixed bottom portion 110 (FIG. 2A). In this collapsed configuration the volume of the internal space is decreased. In an example embodiment the interior volume can be decreased by 8-50% (e.g., between 10-40%, between 12-20%, or between 14-26%) when comparing the collapsed configuration to the expanded configuration.

A collapsible container provided herein can be used for the packaging of any suitable product. In some cases, the product is a smokeless tobacco product. Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos. In addition to fermentation, the tobacco can be processed using other techniques. For example, tobacco can be processed by heat treatment (e.g., cooking, toasting), flavoring, enzyme treatment, expansion and/or curing. Both fermented and non-fermented tobaccos can be processed using these techniques. In some cases, the tobacco can be unprocessed tobacco. Specific examples of suitable processed tobaccos include dark air-cured, dark fire cured, burley, flue cured, and cigar filler or wrapper, as well as the products from the whole leaf stemming operation. In some cases, a collapsible container provided herein can be used for packaging non-tobacco products.

Certain smokeless tobacco products can be supplied in small teabag-like pouches, wherein the pouches are typically made from a nonwoven sheet material. The pouch provides a liquid-permeable container for holding a quantity of smokeless tobacco. Components of the tobacco within the pouch readily diffuse through the pouch material. A collapsible container provided herein can package pouched smokeless tobacco product.

Figure 3:
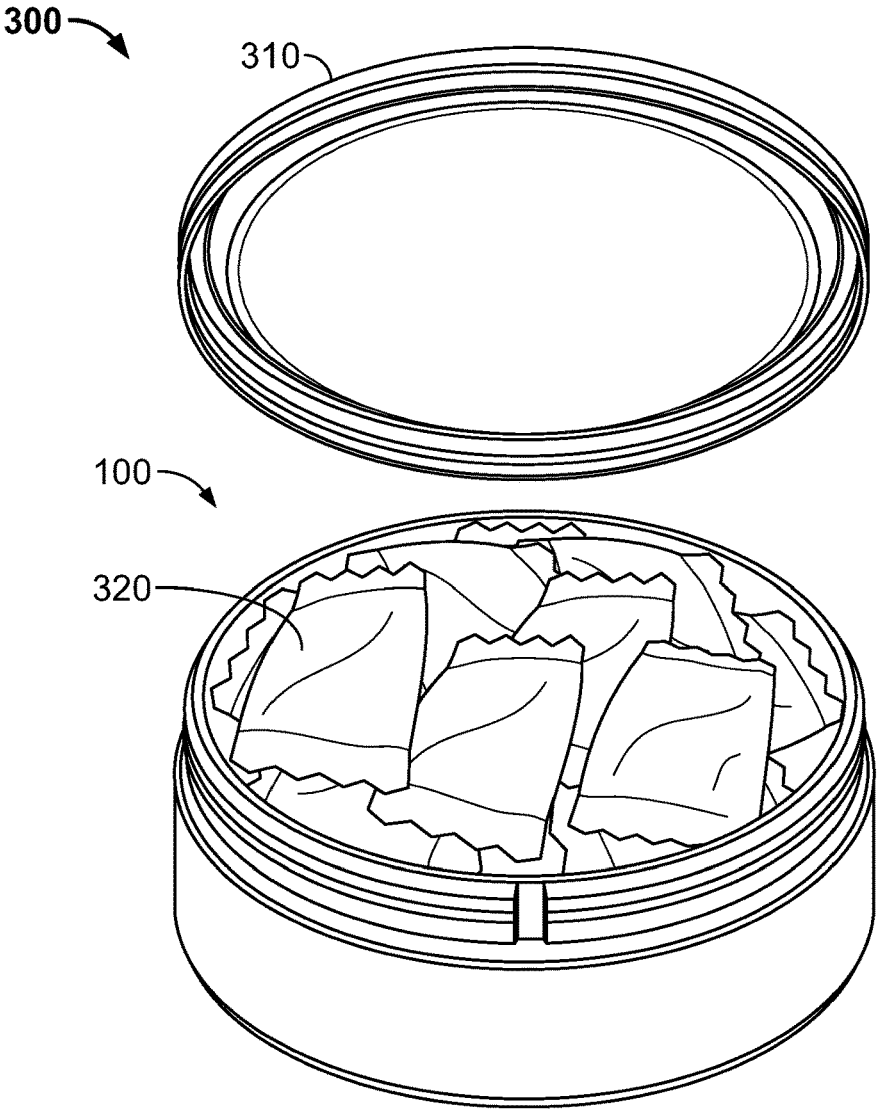
FIG. 3 is an isometric drawing of a collapsible container including pouched product and a lid.

FIG. 3 depicts pouches of smokeless tobacco 320 as the contents of collapsible container 100. As shown, a packaged product 300 generally includes the collapsible container 100, a lid 310, and a product such as pouches of smokeless tobacco 320. While the product is depicted as a pouched tobacco product, any form of smokeless tobacco, non-tobacco products, or any other type of suitable products can be packaged by the collapsible container 100 provided herein. For example, as shown in FIG. 3, pouches of smokeless tobacco 320 can be disposed in the interior space of the collapsible container 100.

The packaged product 300 can include the lid 310. The lid 310 can be formed from a variety of materials and processes such as stamped metal or molded plastic. The lid 310 mates with the top peripheral region, (also referred to herein as a "rim") of the side wall 102, of the collapsible container 100 and can be configured to provide, for example, a snap-fit, a slide-lock, and/or a screw-on engagement. The collapsible container 100 and the lid 310 can be separated from one another so that an adult tobacco consumer can have access to the pouches of smokeless tobacco 320 contained therein. The interior space provided by the collapsible container 100 and the lid 310 can be moisture tight to prevent the pouches of smokeless tobacco 320, and/or other types of product, from drying out. In some cases, the collapsible container 100 can be air-tight (hermetically sealed) as delivered from the manufacturer. In some cases, a lid and a collapsible container provided herein can form a non-hermetic seal. U.S. Pat. No. 7,798,319 to Bried et al., which is incorporated in its entirety herein by reference, describes various embodiments of a tobacco product package including aspects related to sealing the package. For example, U.S. Pat. No. 7,798,319 to Bried et al., which is incorporated in its entirety herein by reference, describes a non-hermetic seal between a lid and a container.

The collapsible container 100, with its increased interior volume when the displaceable portion 108 is in the expanded configuration, provides more space for product such as pouches of smokeless tobacco 320—which can improve the packaging process for at least the following reasons. The seal between the lid 310 and collapsible container 100 can be compromised if some portion of product, such as a portion of a pouch of smokeless tobacco 320, is captured between the sealing interfaces of the lid 310 and collapsible container 100 when the two parts are mated together during manufacturing. Such interference can be known as "wicking." For example, if the product includes pouched smokeless tobacco, the pouches may not settle into the interior space of the container in a uniform fashion, and part of some pouch material may be positioned near or on top of the rim of the container. When a lid is engaged with a container, part of the pouch material may be pinched between the lid and container rim. The seal of the package could thereby be compromised leading to the unintended transfer of air and/or moisture between the product and the atmosphere, resulting in a dried-out or otherwise less desirable product. Some instances of wicking can be invisible to the naked-eye and known as "minor wicking." Conversely, the wicking can be visible to the naked-eye known as "major wicking." The expanded configuration of collapsible containers provided herein can help prevent sealing defects such as wicking by providing more interior space in the collapsible container 100, thereby allowing the typical volume of product, such as pouches of smokeless tobacco 320, to be positioned in the interior space further away from the sealing interfaces of the lid 310 and the collapsible container 100. As will be described in reference to FIG. 5 below, after the lid 310 has been installed onto the collapsible container 100, the collapsible container 100 can then be reconfigured to its collapsed configuration. Using such materials and methods as described above can help prevent wicking, and can do so in a manner that results in a container that is adequately full of product.

In some cases a collapsible container provided herein can include non-tobacco products. An herbal composition can be a non-tobacco product. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, *Echinacea*, Elderberry, Willow bark). Such non-tobacco compositions can have a number of different primary ingredients, including but not limited to, tea leaves, red clover, coconut flakes, mint leaves, *ginseng*, apple, corn silk, grape leaf, and basil leaf. U.S. Pat. No. 7,950,399 to Winterson et al., which is incorporated herein by reference, discloses a non-tobacco pouch product.

Figure 4:
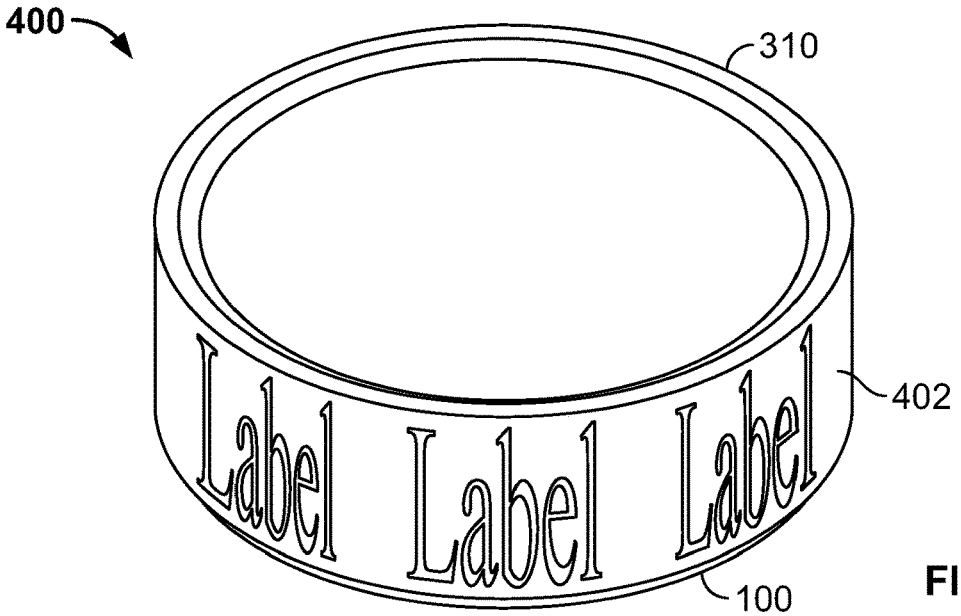
FIG. 4 is an isometric drawing of a collapsible container engaged with a lid having a label around the periphery of the collapsible container and lid.

FIG. 4 depicts an example embodiment of a packaged product 400 using the collapsible container 100 provided herein. The packaged product 400 generally includes the collapsible container 100, the lid 310, the product (not shown), and a label 402. The label 402 can surround the outer periphery of the collapsible container 100. Further, the label 402 can contact a portion of the lid 310. In some embodiments the label 402 can be positioned over the interface region between the lid 310 and the collapsible container 100 so as to provide a seal between them. In some examples the label 402 can provide a hermetic seal between a lid and a collapsible container provided herein.

Figure 5:
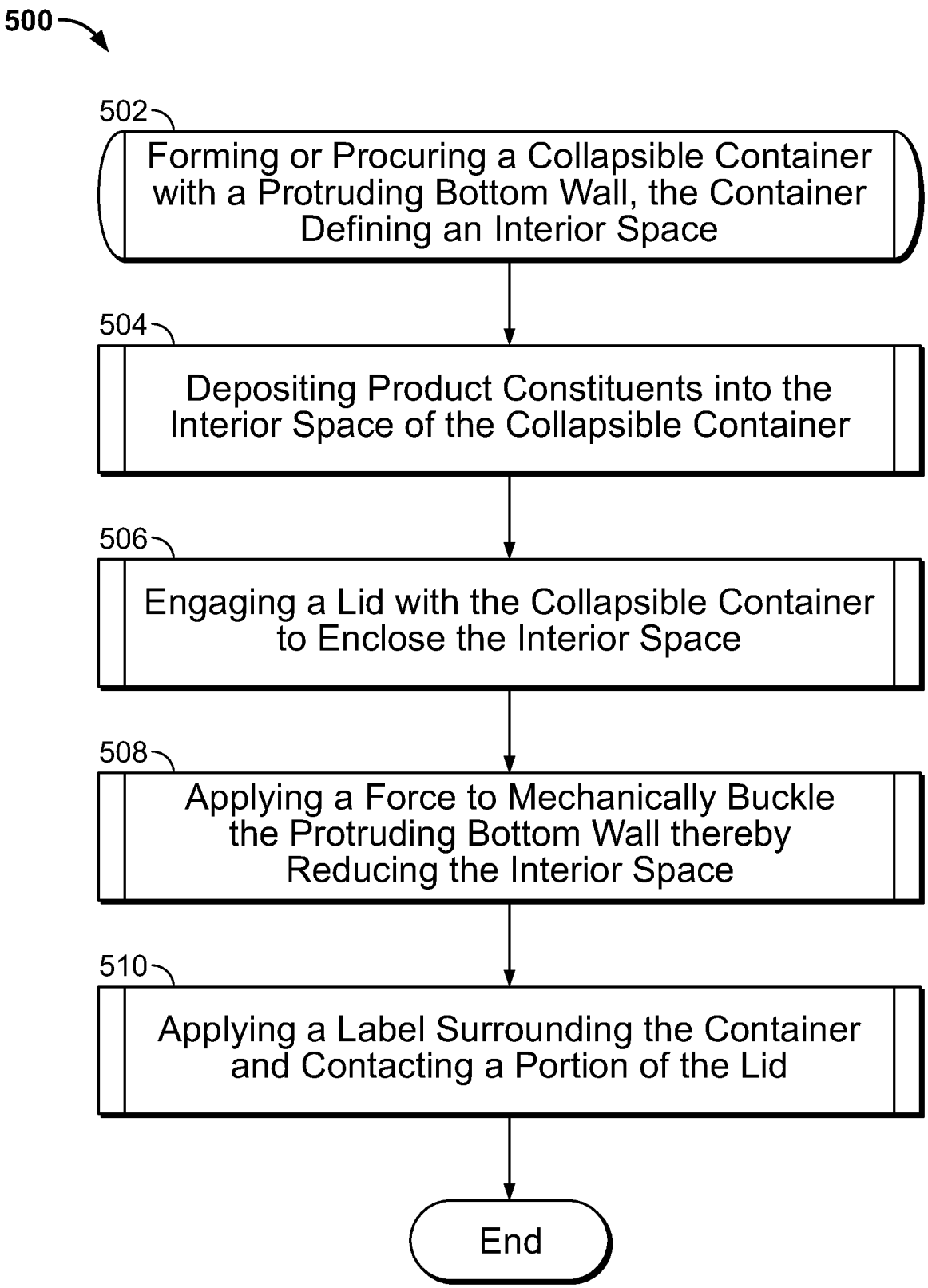
FIG. 5 is a flowchart describing a method of packaging using a collapsible container.

FIG. 5 depicts a packaging process 500 utilizing a collapsible container provided herein (e.g., collapsible container 100) and other related components as described above. In general, the process describes the steps for manufacturing a sealed and labeled package containing a product, such as a smokeless tobacco product.

In optional step 502, a collapsible container provided herein, such as example collapsible container 100, is formed. Collapsible containers can be procured from a supplier manufacturer or distributor. As discussed above, collapsible containers provided herein can be converted between two configurations: (i) an expanded configuration and (ii) a collapsed configuration. In the expanded configuration the open interior space of the collapsible container can have a greater volume than the volume of the open interior space in the collapsed configuration. Collapsible containers can be pre-formed into the expanded configuration. In some cases, collapsible containers provided herein are molded into the expanded configuration. In some cases, collapsible containers provided herein are molded into the collapsed configuration and reconfigured into the expanded configuration for the packaging process 500. The collapsible container can be formed so as to be stable and stationary while the bottom of the container is in contact with a surface such as a table or conveyor device.

Step 504 of the packaging process 500 includes the deposition of product into the interior space of the collapsible container. The collapsible container can be in the expanded configuration at this step. The increased volume of interior space in the expanded container can help ensure that product is not encroaching in the sealing interface areas near the rim of the collapsible container.

Step 506 includes engaging a lid, such as the lid 310 of FIG. 3, with the collapsible container to enclose the product within the interior space of a collapsible container provided herein. The lid can include a metallic material (e.g., aluminum, tin, stainless steel, or the like), or other suitable material, such as a polymer. The lid can also include a gasket for enhancing the seal between the lid and the rim of the collapsible container. The lid can have an additional access port in an inner region of the lid. The lid can have a perimeter region adapted to engage with the rim of the collapsible container. The engagement between the lid and the collapsible container can be, for example, a snap-fit, sliding-fit, press-fit, or screw-fit.

In step 508, a force can be applied to the displaceable portion of collapsible container so as to convert the collapsible container from the expanded configuration to the collapsed configuration. In some cases, step 508 can be performed simultaneously with step 506. In some cases, step 508 can be performed after step 506 is complete. As described previously (FIG. 2A), the conversion can be performed utilizing a snap-through buckling principle. The reduction in the volume of the interior space of the collapsible container associated with this step can cause some amount of air to be expelled from the interior of the container and lid assembly. The reduction in volume also causes the density of the product constituents within the container to increase, thereby giving a visual confirmation that the container is full of product. In some cases, a non-hermetic seal between the lid and a collapsible container provided herein can permit air to escape form the can. Using the manufacturing method 500, the stated container fullness is achieved while still reducing the likelihood of seal imperfections due to interference with the seal from product constituents as described above.

In step 510, a label can be applied to surround the exterior perimeter of the collapsible container and a portion of the lid. In addition to product identification, the label can perform a sealing function. For example, in some examples, an air-tight or hermetically sealed package can be created by applying the label so that it covers the joint between the lid and the collapsible container as depicted in FIG. 4. It is envisioned that the step 510 may, in some examples, be performed prior to the step 508.

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A method of packaging a consumer product, the method comprising:

depositing a product into a collapsible container, the collapsible container including, a peripheral side wall having a top edge and a bottom edge, and a bottom wall attached to the bottom edge of the peripheral side wall, the bottom wall including a displaceable portion, the displaceable portion including a conical side wall defining a truncated cone shape, the bottom wall having a variable wall thickness defining a concave exterior surface and including a thinner wall portion at a center of the bottom wall and a thicker wall portion disposed outward of the thinner wall portion, the thicker wall portion surrounding the thinner wall portion and the thicker wall portion extending along an outer periphery of the bottom wall, the bottom wall being disposed in an expanded configuration in which the bottom wall extends below the bottom edge of the peripheral side wall;

applying a force to the concave exterior surface of the displaceable portion, the applying causing the displaceable portion to mechanically buckle and thereafter be disposed in a collapsed configuration in which the bottom wall extends above the bottom edge of the peripheral side wall;

engaging a lid with a top peripheral region of the peripheral side wall, the lid retaining the product within the collapsible container, and the engaging being performed prior to the applying a force;

applying a label to the collapsible container so as to cover at least a portion of the lid and at least a portion of the collapsible container with the label, the label hermetically sealing the collapsible container and the lid, the applying a label occurring prior to the applying a force; and screwing the lid onto the collapsible container, the lid and the collapsible container being coupled via a screw fit.

2. The method of claim 1, further comprising:

prior to the depositing, applying a force to the displaceable portion to shift the collapsible container from the collapsed configuration to the expanded configuration.

* * * * *